US007832712B1

(12) United States Patent
Clarke

(10) Patent No.: US 7,832,712 B1
(45) Date of Patent: Nov. 16, 2010

(54) CABLE PULLER FOR LIFTING WIRE ROPE AND ELECTRIC CORDS AND ASSOCIATED METHOD

(76) Inventor: Andrew Clarke, 105 SE. Bonita Ct., Port Saint Lucie, FL (US) 34983

( * ) Notice: Subject to any disclaimer, the term of this patent is extended or adjusted under 35 U.S.C. 154(b) by 132 days.

(21) Appl. No.: 12/319,724

(22) Filed: Jan. 12, 2009

Related U.S. Application Data

(60) Provisional application No. 61/011,220, filed on Jan. 17, 2008.

(51) Int. Cl.
*B66D 3/08* (2006.01)

(52) U.S. Cl. ..... 254/393; 254/401; 254/404; 254/416; 187/239; 187/325; 187/406

(58) Field of Classification Search ..... 254/393, 254/401, 404, 416; D8/360; 414/490, 494; 187/239, 325, 406
See application file for complete search history.

(56) References Cited

U.S. PATENT DOCUMENTS 1,310,598 A * 7/1919 Blaw ..... 254/401
2,841,020 A * 7/1958 Van Deventer, IV ..... 474/171
3,671,015 A * 6/1972 Sullivan ..... 254/332
4,074,789 A 2/1978 Warren et al.
4,309,023 A 1/1982 Plumettaz
4,441,849 A 4/1984 Dizmang
6,041,476 A * 3/2000 deNormand ..... 16/197
6,257,262 B1 * 7/2001 Anitole ..... 135/123
7,543,799 B2 * 6/2009 Willis et al. ..... 254/336

* cited by examiner

*Primary Examiner*—Emmanuel M Marcelo

(57) ABSTRACT

A pulley suspension assembly for assisting a user to vertically transport a cable to an elevated location may include a base member adapted to be positioned at the elevated location. A plurality of prongs may be statically coupled the base, extended upwardly therefrom, and seated adjacent to a rear edge thereof. A rectilinear guide rail may be statically mated to the prongs and spanned therebetween. Additionally, a plurality of stabilizing brackets may be statically affixed to the top surface and front of the base member. Further, a rectilinear shaft may be connected to the brackets and spanned therebetween. A plurality of pulleys may be journaled about the rectilinear shaft and rotatable thereabout. Such pulleys may be uniformly juxtaposed side-by-side and freely reciprocated along the shaft while rotating about the fulcrum axis. Anchor cables may be included and engaged with the prongs and an existing support surface at the elevated location.

17 Claims, 4 Drawing Sheets

CABLE PULLER FOR LIFTING WIRE ROPE AND ELECTRIC CORDS AND ASSOCIATED METHOD

CROSS REFERENCE TO RELATED APPLICATIONS

This application claims the benefit of U.S. Provisional Application No. 61/011,220, filed Jan. 17, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to suspension assemblies and, more particularly, to a pulley suspension assembly for assisting a user to vertically transport a cable to an elevated location.

2. Prior Art

Prior devices for supporting scaffolds have utilized fixed supports anchored to side wall columns or other structural members, requiring dismantling of same to move the scaffolds to required new positions. This is the time consuming and inefficient. Floor supported scaffolds have been used on some buildings wherein relatively low side walls are involved, however these must also be dismantled and moved as work progresses along the side wall. It is known in the art to provide suspended scaffolding for working at elevated heights, however, suitable suspension means are still lacking.

U.S. Pat. No. 4,074,789 to Warren discloses a rolling support for moving scaffolding alongside the side or end of a building under construction. The support includes a frame structure which rigidly connects a leading outrigger and a trailing outrigger together. Each of such outriggers has a near-side traveling wheel to ride on an exposed structural roof member adjacent the side or end of a building, and a far side force roller which extends beneath a parallel exposed structural roof member inwardly from the side or end of the building. The outriggers are parallel to one another and ride on parallel exposed structural roof members. The near-side travel wheel bears down on its exposed roof member and exerts substantial downward pressure thereon while the far-side force roller bears upwardly against the underside of its exposed roof member. Remote controlled motor means are mounted on the frame so as to drive the near-side traveling wheel. Unfortunately, this prior art reference does not provide a lightweight, compact, and portable means of assisting a user to transport scaffold cable onto an elevated surface.

U.S. Pat. No. 4,309,023 to Plumettaz discloses an apparatus for suspending a scaffold or the like, used for working on the outer walls of buildings. The apparatus comprises a capstan made up of four pairs of pulleys driven by an electric motor. The pulleys have grooves for receiving suspension cables, each of which is wound over a pair of pulleys in five turns. On the slack-portion side, each cable is guided over a traverse mechanism, then runs onto a reel mounted via friction couplings on a shaft. This shaft is driven by the motor when the scaffold is raised, while during the descent it is locked by a mono-directional coupling, a driving wheel then being free on the shaft. A safety release device intended to intervene in case of lessening of the tractive force yielded by the friction couplings is combined with the traverse mechanism. If the tension of the slack portion of cable drops below a given threshold, a safety release cuts off the current supply to the motor and actuates an electromagnetic brake. Unfortunately, this prior art reference intended to mount and hold an elevated scaffolding and not to assist a user in guiding and transporting scaffold cable onto a rooftop.

U.S. Pat. No. 4,441,849 to Dizmang discloses a light weight carriage having a flat bed and a pivotal ramp. The carriage includes a winch and counterbalance assembly which is first hauled to the roof of a building or other elevated location. Gutter guards are then installed to the carriage, and the ramp is placed in its supported inclined position. A separate platform or pallet to which a load is attached, and having a plurality of small wheels thereunder, is connected to the cable of the winch on the carriage and is winched up the wall of the building, over the gutter guards, over a wheel-protecting block on the ramp and into its final position on the ramp. The ramp is thereafter lowered and the assembly is used like a dolly to move the load to its final location. Unfortunately, this prior art reference does not disclose a plurality of pulleys and guides to safely direct a cable pulled therethrough while reducing frictional contact and the required labor need to raise heavy cable.

Another prior art example includes a drum that has a circular-grooved surface on which a cable reserve is wound. One end of the cable is secured to the drum, which rotates while being driven by a control motor in one direction or the other, depending upon whether the scaffold is to be raised or lowered. Thus, the scaffold is connected to the support at a fixed point to which one end of the cable is attached. Such a drum assembly is extremely bulky, for the cable reserve must be laid down in a single layer on the drum, and this leads to extremely large-sized drums. The large size of the drum complicates the construction of the winch and increases its weight, and this can complicate the arrangement of the track provided at the top of the wall for displacing the support.

Accordingly, a need remains for a pulley suspension assembly in order to overcome the above-noted shortcomings. The present invention satisfies such a need by providing an assembly that is convenient and easy to use, is durable yet lightweight in design, is versatile in its applications, and provides a means for assisting a user to vertically transport a cable to an elevated location.

BRIEF SUMMARY OF THE INVENTION

In view of the foregoing background, it is therefore an object of the present invention to provide an assembly for assisting a user to vertically transport a cable to an elevated location. These and other objects, features, and advantages of the invention are provided by an a pulley suspension assembly for assisting a user to vertically transport a cable to an elevated location.

A pulley suspension assembly for assisting a user to vertically transport a cable to an elevated location may include a base member adapted to be positioned at the elevated location. Such an elevated location may include the rooftop of a building, a top section of scaffolding, or any other elevated surface where a user may necessarily require cable to be transported to, as is understood by one skilled in the art. Further, the pulley suspension assembly may include a plurality of prongs statically coupled to the base member and preferably seated adjacent to a rear edge thereof. Such prongs may extend upwardly from a top surface of the base member and may be registered orthogonal thereto. Depending on the diameter of cable to be utilized with the assembly, the prongs may be produced in a variety of diameters and heights to best assist the user in guiding the cable onto the elevated surface. The assembly may also include a rectilinear guide rail statically mated to the prongs respectively and spanned therebetween.

The pulley suspension assembly may additionally include a plurality of stabilizing brackets statically affixed to the top surface of the base member. Such stabilizing brackets may be oppositely seated from the prongs and situated at a front edge of the base member. In operation, the stabilizing brackets may be located near the edge of the elevated surface where the cable is being drawn over, and may advantageously assist the user in maintaining the stability of the base member to ensure the cable is safely guided onto the elevated location.

The pulley suspension assembly may further include a rectilinear shaft fixedly connected to the brackets and spanning therebetween. In addition, the assembly may include a plurality of pulleys journaled about the rectilinear shaft and rotatable about a fulcrum axis extending along the shaft. Such pulleys may be uniformly juxtaposed side-by-side such that the pulleys may be freely reciprocated along the shaft while rotating about the fulcrum axis. The pulleys are vital and advantageous in that they may permit the cable to be easily drawn over the base member and pulled onto the roof with little frictional resistance. In operation, the user may direct the cable over the pulleys and between the prongs to more quickly and easily transport the length of the cable onto the elevated surface. The pulleys may be intercalated between the brackets to thereby provide a continuous and uniform surface for receiving and directing the cable to the elevated location.

The assembly may also include a plurality of anchor cables, preferably having respective first ends removably engaged with the prongs. Such anchor cables may further include respective second ends adapted to be anchored to an existing support surface at the elevated location for preventing the base member from undesirably moving away from the preferred location. Thus, a user may advantageously utilize the anchor cables by fastening them to a fixture on the roof of the building where the cable is to be transported to, thereby ensuring the base member stays in place while the cable is being drawn over the pulleys and between the prongs.

Each of the prongs may additionally have respective longitudinal lengths registered orthogonal to the top surface of the base member. The guide rail may be elevated above the top surface of the base member and may maintain a first vertical distance therefrom. Each of the pulleys may have coextensive diameters so that respective outer perimeters of the pulleys may remain coplanar and uniformly spanned between the brackets. The coextensive diameters may allow the pulleys to remain aligned with each other almost seamlessly, advantageously allowing the cable to move from one pulley to the next with little resistance. This is vital for allowing the cable to be easily drawn over the pulleys even when the cable may shift from side to side during the process of pulling the cable onto the elevated surface.

Further, selected ones of the pulleys may be independently rotatable about the shaft while remaining ones of the pulleys may remain stationary. Thus, if the cable shifts from one pulley to the next, each pulley may rotate separately to assist the user in pulling the cable onto the elevated surface. This provides the unexpected and unpredictable benefit of providing space for the cable to shift from side to side during operation, while also preventing the need for a heavier, more resistant, single large pulley.

The pulley suspension assembly may further include a top-most section of the outer perimeters of the pulleys maintaining a fixed second vertical distance from the top surface of the base member. The second vertical distance may be equal for each of the pulleys. The first vertical distance may be less than the second vertical distance, thereby defining a downwardly sloping travel path extending towards the rear edge of the base member.

The guide rail at the first vertical distance may therefore be oriented slightly below the top-most section of the outer perimeters of the pulleys. This is advantageous in that it may prevent the cable from sloping downward after traveling over the pulleys. At all times, the cable may slope either upward or horizontally and parallel to the base member. This provides the unexpected and unpredictable benefit of reducing the frictional contact between the cable and pulleys and permitting the user to more easily draw the cable onto the elevated surface.

The pulley suspension assembly further may include a plurality of disc-shaped washers intercalated between oppositely seated ones of the pulleys and corresponding ones of the brackets. Such washers may be configured in such a manner that the pulleys may be prohibited from engaging the brackets during operating conditions. This may advantageously prohibit the pulleys from coming in contact with the brackets and thereby causing unwanted friction that may slow the process of transporting the cable between the brackets and onto the elevated surface.

Each of the pulleys may include a primary bearing concentrically journaled about the shaft. In addition, the pulleys may each include a rigid outer layer concentrically spaced about the primary bearing such that a cavity may be defined between the rigid outer surface and the primary bearing. The outer layer may be adapted to receive and guide the cable therealong. Further, a plurality of auxiliary ball bearings may be intercalated between the outer layer and the primary bearing respectively. The auxiliary bearings may be arranged in such a manner that the auxiliary bearings may be freely rotatable and displaced within the cavity. Additionally, a protective sheath may be included, conjoining an inner wall of the rigid outer layer. Such a protective sheath may be contiguously abutted against an entire inner perimeter of the rigid outer layer for shielding the inner wall from the auxiliary bearings as the auxiliary bearing are displaced within the cavity during operating conditions.

The present invention may further include a method for using a pulley suspension assembly to vertically transport a cable to an elevated location. Such a method may include the chronological steps of first providing and positioning a base member at the elevated location. Second, the method may include providing and statically coupling a plurality of prongs to the base member such that the prongs may be seated adjacent to a rear edge of the base member. The prongs may extend upwardly from a top surface of the base member and may be registered orthogonal thereto. Third, the method may include providing and statically mating a rectilinear guide rail to the prongs such that the guide rail may span therebetween. A fourth step of the method may entail providing and statically affixing a plurality of stabilizing brackets to the top surface of the base member by oppositely seating such stabilizing brackets from the prongs and thereby situating the stabilizing brackets at a front edge of the base member. Fifth, the method may include providing and fixedly connecting a rectilinear shaft to the brackets such that the shaft may span therebetween. Next, the method may include a sixth step of providing and journaling a plurality of pulleys about the shaft such that the pulleys may be rotatable about a fulcrum axis extending along the shaft.

The method may include a seventh step of freely reciprocating the pulleys along the shaft while rotating the pulleys about the fulcrum axis. An eighth step may include providing and removably engaging respective first ends of a plurality of anchor cables with the prongs, follow by a ninth step of preventing the base member from undesirably moving away from the desired location by anchoring respective second ends of the anchor cables to an existing support surface at the elevated location. Finally, a tenth step of the method may include providing a continuous and uniform surface for receiving and directing the cable to the elevated location by intercalating the pulleys between the brackets and uniformly juxtaposing the pulleys side-by-side respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
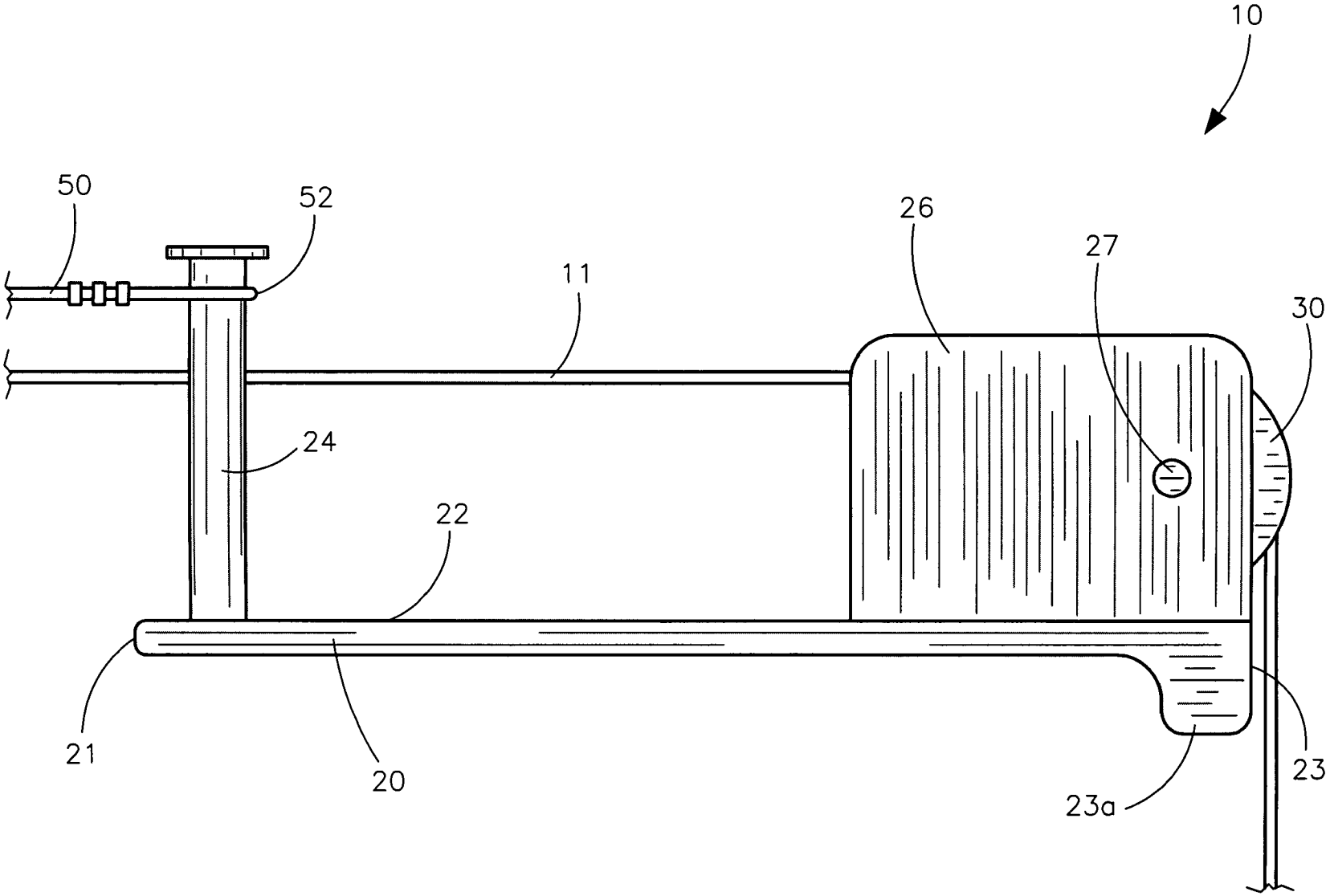
FIG. 1 is a side elevational view showing a pulley suspension assembly, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIG. 14 by the reference numeral 10 and is intended to provide a pulley suspension assembly. The present invention advantageously reduces the labor required to pull the wire rope(s) up, and enhances the safety of those performing that labor. Since it may be compact and portable in design, the assembly may be produced of industrial-grade cast aluminum, with precision ball bearings, components that provide heavy-duty, dependable service for extended periods of time. It should be understood that the pulley suspension assembly 10 may be used to assist a user in transporting many different types of cables, ropes and electric lines (electric are much heavier than cables and ropes) to various elevations, such as electric suspended scaffoldings, and should not be limited to the applications discussed herein. As an example, the present invention may be used to lift 5/16" wire rope used in suspended scaffolding.

Referring initially to FIGS. 1-4, a pulley suspension assembly 10 for assisting a user to vertically transport a cable 11 to an elevated location may include a base member 20 adapted to be positioned at the elevated location. Such an elevated location may include the rooftop of a building, a top section of scaffolding, or any other elevated surface where a user may necessarily require cable 11 to be transported to, as is understood by one skilled in the art. The base member 20 may further include a lip 23A on an underside thereof and located on the front edge 23 of the base member 20. This may advantageously permit the base member 20 to be more securely placed and stabilized on the edge of an elevated surface.

Further, the pulley suspension assembly 10 may include a plurality of prongs 24 statically coupled to the base member 20 and preferably seated adjacent to a rear edge 21 thereof. Such prongs 24 may extend upwardly from a top surface 22 of the base member 20 and may be registered orthogonal thereto. Depending on the diameter of cable 11 to be utilized with the assembly 10, the prongs 24 may be produced in a variety of diameters and heights to best assist the user in guiding the cable 11 onto the elevated surface. The assembly 10 may also include a rectilinear guide rail 25 statically mated to the prongs 24 respectively and spanned therebetween.

Again referring to FIGS. 1-4, the pulley suspension assembly 10 may additionally include a plurality of stabilizing brackets 26 statically affixed to the top surface 22 of the base member 20. Such stabilizing brackets 26 may be oppositely seated from the prongs 24 and situated at a front edge 23 of the base member 20. In operation, the stabilizing brackets 26 may be located near the edge of the elevated surface 22 where the cable 11 is being drawn over, and may advantageously assist the user in maintaining the stability of the base member 20 to ensure the cable 11 is safely guided onto the elevated location.

Again referring to FIGS. 1-4, the pulley suspension assembly 10 may further include a rectilinear shaft 27 fixedly connected to the brackets 26 and spanning therebetween. In addition, the assembly 10 may include a plurality of pulleys 30 journaled about the rectilinear shaft 27 and rotatable about a fulcrum axis extending along the shaft 27. Such pulleys 30 may be uniformly juxtaposed side-by-side such that the pulleys 30 may be freely reciprocated along the shaft 27 while rotating about the fulcrum axis. The pulleys 30 are vital and advantageous in that they may permit the cable 11 to be easily drawn over the base member 20 and pulled onto the elevated surface with little frictional resistance. In operation, the user may direct the cable 11 over the pulleys and between the prongs 24 to more quickly and easily transport the length of the cable 11 onto the elevated surface. The pulleys 30 may be intercalated between the brackets 26 to thereby provide a continuous and uniform surface 22 for receiving and directing the cable 11 to the elevated location.

Figure 3:
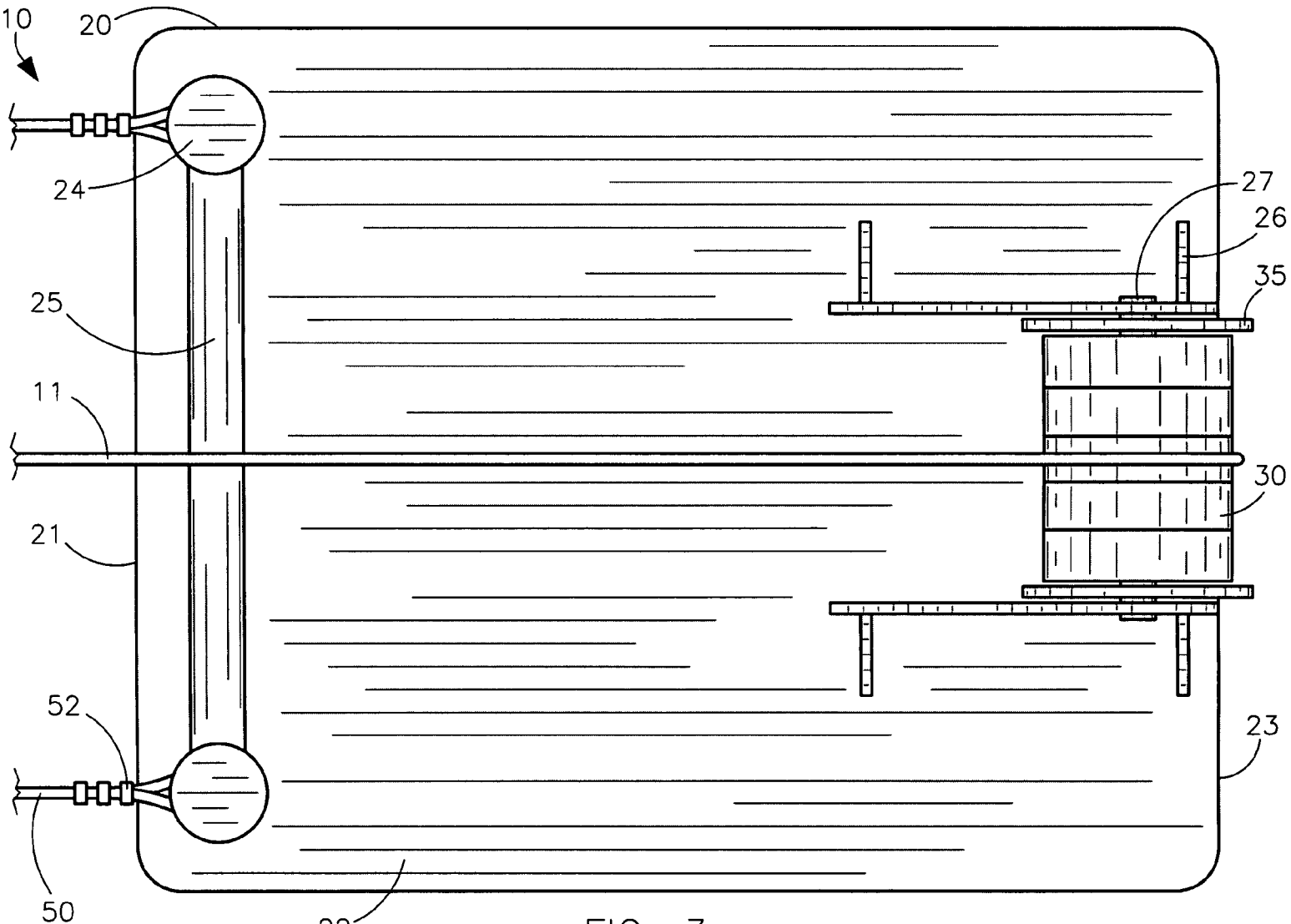
FIG. 3 is a top plan view of the assembly shown in FIG. 1, showing the path of the cable over the plurality of pulleys and between the plurality of prongs.
Figure 4:
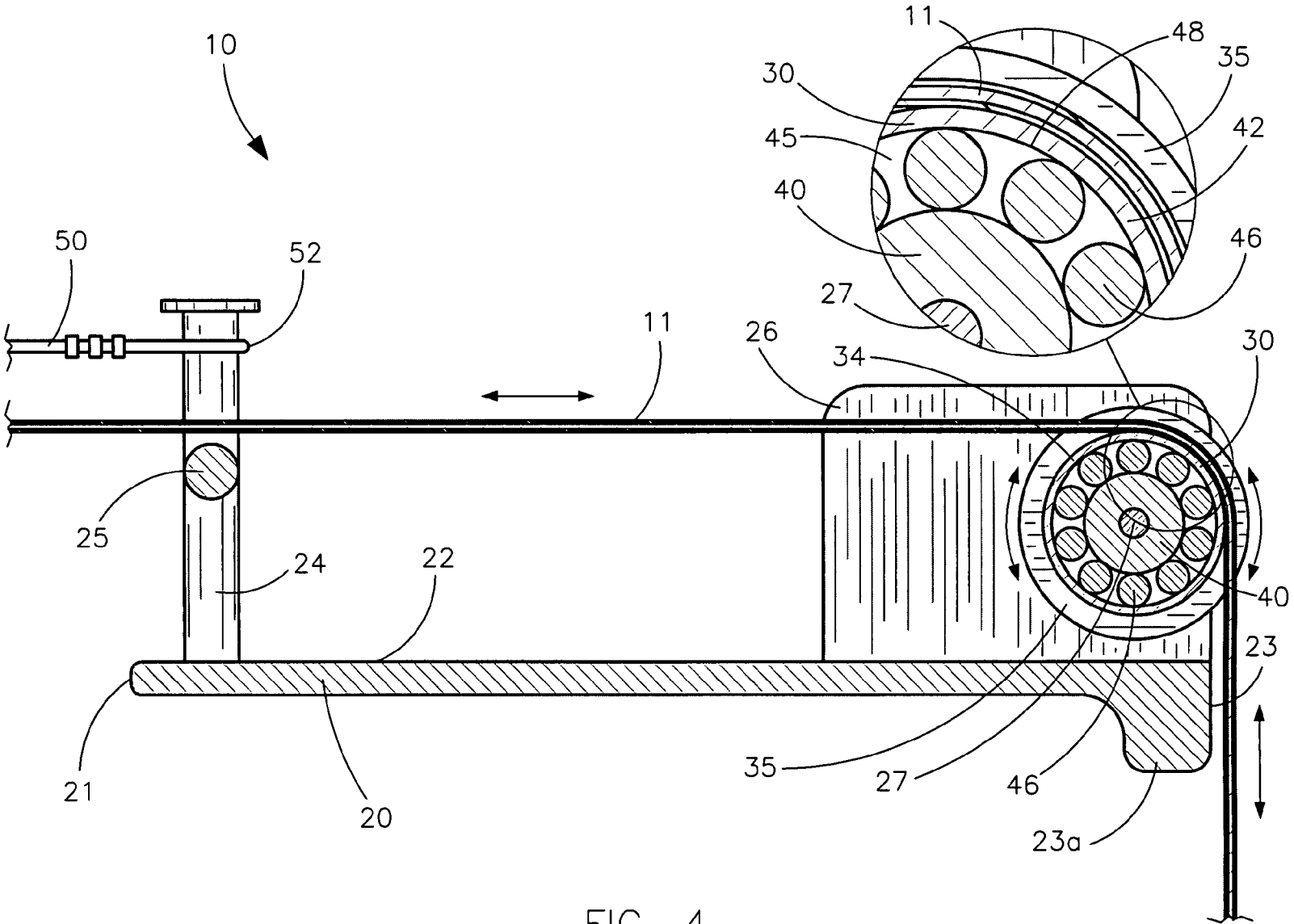
FIG. 4 is a cross-sectional view of the assembly shown in FIG. 2, along line 4, with encircled and enlarged view of the primary bearing and plurality of auxiliary ball bearings.

Now referring to FIGS. 1, 3, and 4, the assembly 10 may also include a plurality of anchor cables 50 preferably having respective first ends 52 removably engaged with the prongs 24. Such anchor cables 50 may further include respective second ends adapted to be anchored to an existing support surface at the elevated location for preventing the base member 20 from undesirably moving away from the preferred location. Thus, a user may advantageously utilize the anchor cables 50 by fastening them to a fixture on the roof of the building where the cable 11 is to be transported to; thereby ensuring the base member 20 stays in place while the cable 11 is being drawn over the pulleys 30 and over the guide rail 25.

Figure 2:
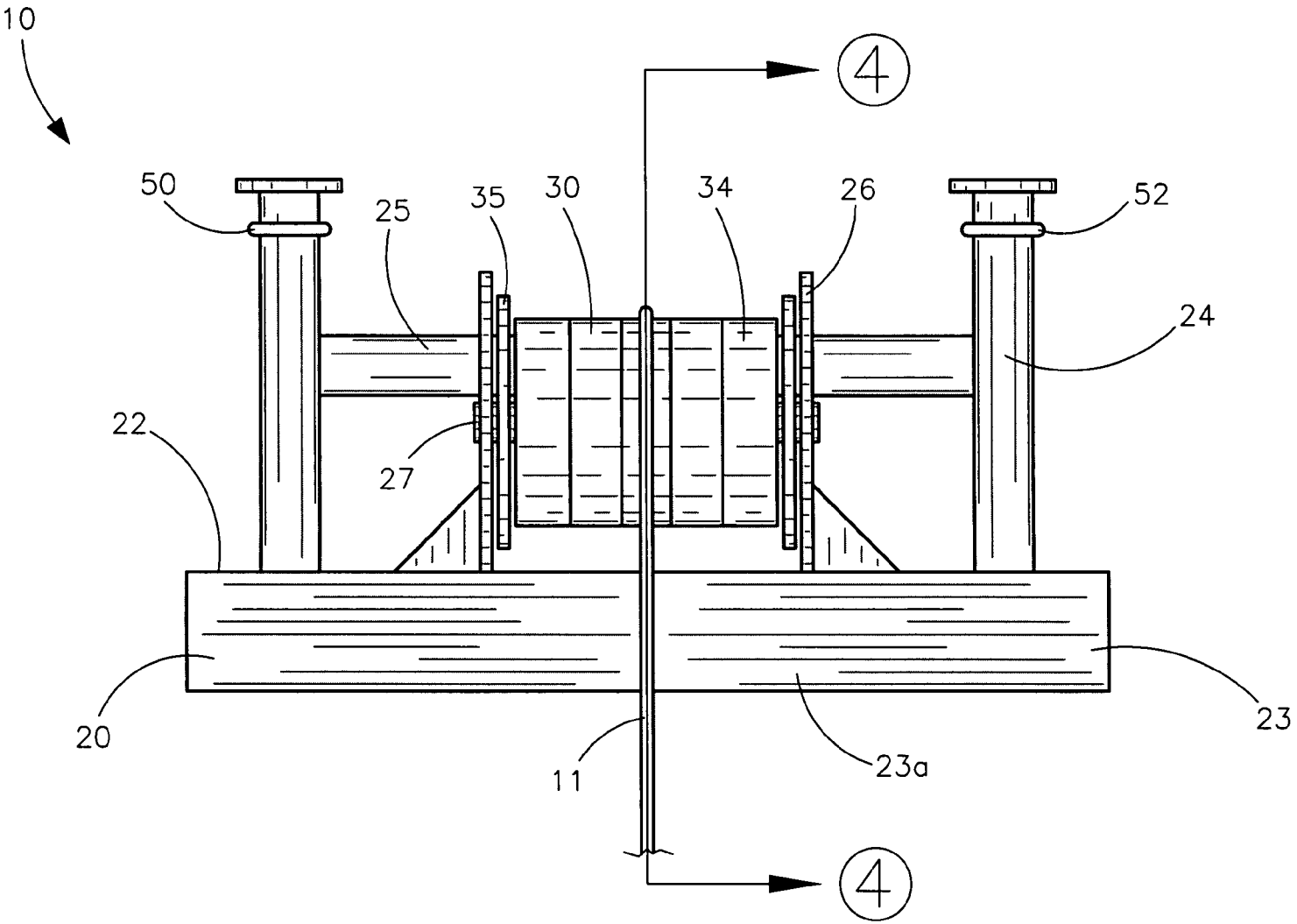
FIG. 2 is a front elevational view of the assembly shown in FIG. 1, showing the plurality of pulleys with the cable running thereover.

Referring to FIGS. 2-3, each of the prongs 24 may additionally have respective longitudinal lengths registered orthogonal to the top surface 22 of the base member 20. The guide rail 25 may be elevated above the top surface 22 of the base member 20 and may maintain a first vertical distance therefrom. In addition, each of the pulleys 30 may have coextensive diameters such that respective outer perimeters of the pulleys 30 may remain coplanar and uniformly spanned between the brackets 26. The coextensive diameters may allow the pulleys 30 to remain aligned with each other almost seamlessly, advantageously allowing the cable 11 to move from one pulley to the next with little resistance.

This is vital for allowing the cable 11 to be easily drawn over the pulleys 30 even when the cable 11 may shift from side to side during the process of pulling the cable 11 onto the elevated surface 22. Further, selected ones of the pulleys 30 may be independently rotatable about the shaft 27 while remaining ones of the pulleys 30 may remain stationary. Thus, if the cable 11 shifts from one pulley to the next, each pulley 30 may rotate separately to assist the user in pulling the cable 11 onto the elevated surface 22. This provides the unexpected and unpredictable benefit of providing space for the cable 11 to shift from side to side during operation, while also preventing the need for a heavier, more resistant, single large pulley.

Now referring specifically to FIGS. 2 and 4, the pulley suspension assembly 10 may further include a top-most section 34 of the outer perimeters of the pulleys 30 maintaining a fixed second vertical distance from the top surface 22 of the base member 20. The second vertical distance may be equal for each of the pulleys 30. The first vertical distance may be less than the second vertical distance, thereby defining a downwardly sloping travel path extending towards the rear edge 21 of the base member 20. The guide rail 25 at the first vertical distance may therefore be oriented slightly below the top-most section 34 of the outer perimeters of the pulleys 30. This may advantageously prevent the cable 11 from sloping downward after traveling over the pulleys 30. At all times, the cable 11 may slope either upward or horizontally and parallel to the base member 20. This provides the unexpected and unpredictable benefit of reducing the frictional contact between the cable 11 and pulleys 30 and permitting the user to more easily draw the cable 11 onto the elevated surface 22.

Referring now to FIGS. 2 and 3, the pulley suspension assembly 10 further may include a plurality of disc-shaped washers 35 intercalated between oppositely seated ones of the pulleys 30 and corresponding ones of the brackets 26. Such washers 35 may be configured in such a manner that the pulleys 30 may be prohibited from engaging the brackets 26 during operating conditions. This may advantageously prohibit the pulleys 30 from coming in contact with the brackets 26 and thereby causing unwanted friction that may slow the process of transporting the cable 11 between the brackets 26 and onto the elevated surface.

Specifically referring to FIG. 4, each of the pulleys 30 may include a primary bearing 40 concentrically journaled about the shaft 27. In addition, the pulleys 30 may each include a rigid outer layer 42 concentrically spaced about the primary bearing 40 such that a cavity 45 may be defined between the rigid outer layer 42 and the primary bearing 40. The outer layer 42 may be adapted to receive and guide the cable 11 therealong. Further, a plurality of auxiliary ball bearings 46 may be intercalated between the outer layer 42 and the primary bearing 40 respectively. The auxiliary bearings 46 may be arranged in such a manner that the auxiliary bearings 46 may be freely rotatable and displaced within the cavity 45. Additionally, a protective sheath 48 may be included, conjoining an inner wall of the rigid outer layer 42. Such a protective sheath 48 may be contiguously abutted against an entire inner perimeter of the rigid outer layer 42 for shielding the inner wall from the auxiliary bearings 46 as the auxiliary bearings 46 are displaced within the cavity 45 during operating conditions.

Referring to FIGS. 1-4 in general, the present invention may further include a method for using a pulley suspension assembly 10 to vertically transport a cable 11 to an elevated location. Such a method may include the chronological steps of first providing and positioning a base member 20 at the elevated location. Second, the method may include providing and statically coupling a plurality of prongs 24 to the base member 20 such that the prongs 24 may be seated adjacent to a rear edge 21 of the base member 20. The prongs 24 may extend upwardly from a top surface 22 of the base member 20 and may be registered orthogonal thereto. Third, the method may include providing and statically mating a rectilinear guide rail 25 to the prongs 24 such that the guide rail 25 may span therebetween.

A fourth step of the method may entail providing and statically affixing a plurality of stabilizing brackets 26 to the top surface 22 of the base member 20 by oppositely seating such stabilizing brackets 26 from the prongs 24 and thereby situating the stabilizing brackets 26 at a front edge 23 of the base member 20. Fifth, the method may include providing and fixedly connecting a rectilinear shaft 27 to the brackets 26 such that the shaft 27 may span therebetween. Next, the method may include a sixth step of providing and journaling a plurality of pulleys 30 about the shaft 27 such that the pulleys 30 may be rotatable about a fulcrum axis extending along the shaft 27.

The method may include a seventh step of freely reciprocating the pulleys 30 along the shaft 27 while rotating the pulleys 30 about the fulcrum axis. An eighth step may include providing and removably engaging respective first ends 52 of a plurality of anchor cables 50 with the prongs 24, follow by a ninth step of preventing the base member 20 from undesirably moving away from the desired location by anchoring respective second ends of the anchor cables 50 to an existing support surface 22 at the elevated location. Finally, a tenth step of the method may include providing a continuous and uniform surface 22 for receiving and directing the cable 11 to the elevated location by intercalating the pulleys 30 between the brackets 26 and uniformly juxtaposing the pulleys 30 side-by-side respectively.

The combination of the method with the claimed elements provides an unpredictable and unexpected result which is not rendered obvious by one skilled in the art. The present invention 10 may advantageously allow a user to transport extended lengths of cable 11 onto an elevated surface with reduced friction and guidance to prevent unwanted movement of the cable 11 during transportation. The plurality of pulleys 30 is vital for allowing limited movement of the cable 11 during operation with pulleys 30 of reduced size for a substantial reduction of frictional resistance. The base member 20 may be easily positioned on the edge of an elevated surface, secured by the anchor cables 50, utilized to transport lengths of cable 11, and later repositioned as necessary. Thus, the present invention 10 may reduce the required labor necessary for transporting heavy cable 11 used in scaffolding, and may enhance the safety of those performing that labor by guiding and restricting the movement of the cable 11 during operation.

In an alternate embodiment, additional stabilizing brackets 26 and sets of pulleys 30 may be included where multiple cables 11 may be needed to be transported onto the elevated surface simultaneously, thereby keeping the cables 11 separated from each other and maintaining low frictional resistance. Additional embodiments may include a more permanent set of fasteners to replace the anchor cables 50, such as screw or bolt fasteners, for times when adequate support fixtures are not available for attaching the second ends of the anchor cables 50.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A pulley suspension assembly for assisting a user to vertically transport a cable to an elevated location, said pulley suspension assembly comprising:

a base member adapted to be positioned at the elevated location;

a plurality of prongs coupled said base member and being seated adjacent to a rear edge of said base member, said prongs extending upwardly from a top surface of said base member;

a guide rail statically mated to said prongs and spanning therebetween;

a plurality of stabilizing brackets statically affixed to said top surface of said base member, said stabilizing brackets being oppositely seated from said prongs and situated at a front edge of said base member;

a shaft fixedly connected to said brackets and spanning therebetween;

a plurality of pulleys journaled about shaft and being rotatable about a fulcrum axis extending along said shaft, said pulleys being uniformly juxtaposed side-by-side such that said pulleys are freely reciprocated along said shaft while rotating about the fulcrum axis; and a plurality of anchor cables having respective first ends removably engaged with said prongs, said anchor cables further having respective second ends adapted to be anchored to an existing support surface at the elevated location for preventing said base member from undesirably moving away from the desired location;

wherein said pulleys are intercalated between said brackets and thereby provide a continuous and uniform surface for receiving and directing the cable to the elevated location.

2. The pulley suspension assembly of claim 1, wherein each of said prongs having respective longitudinal lengths registered orthogonal to said top surface of said base member, said guide rail being elevated above said top surface of said base member and maintaining a first vertical distance therefrom.

3. The pulley suspension assembly of claim 1, wherein each of said pulleys have coextensive diameters so that respective outer perimeters of said pulleys remain coplanar and uniformly span between said brackets.

4. The pulley suspension assembly of claim 3, wherein a top-most section of said outer perimeters of said pulleys maintain a fixed second vertical distance from said top surface of said base member, said second vertical distance being equal for each of said pulleys.

5. The pulley suspension assembly of claim 4, wherein said first vertical distance is less than said second vertical distance thereby defining a downwardly sloping travel path extending towards said rear edge of said base member.

6. The pulley suspension assembly of claim 1, wherein selected ones of said pulleys are independently rotatable about said shaft while remaining ones of said pulleys remain stationary.

7. The pulley suspension assembly of claim 1, further comprising: a plurality of disc-shaped washers intercalated between oppositely seated ones of said pulleys and corresponding ones of said brackets, said washers being configured in such a manner that said pulleys are prohibited from engaging said brackets during operating conditions.

8. The pulley suspension assembly of claim 1, wherein each of said pulleys comprises:

a primary bearing concentrically journaled about said shaft;

a rigid outer layer concentrically spaced about said primary bearing such that a cavity is defined between said rigid outer surface and said primary bearing, said outer layer being adapted to receive and guide the cable therealong;

a plurality of auxiliary ball bearings intercalated between said outer layer and said primary bearing respectively, said auxiliary bearings being arranged in such a manner that said auxiliary bearings are freely rotatable and displaced within said cavity; and a protective sheath conjoining an inner wall of said rigid outer layer, said protective sheath being contiguously abutted against an entire inner perimeter of said rigid outer layer for shielding said inner wall from said auxiliary bearings as said auxiliary bearing are displaced within said cavity during operating conditions.

9. A pulley suspension assembly for assisting a user to vertically transport a cable to an elevated location, said pulley suspension assembly comprising:

a base member adapted to be positioned at the elevated location;

a plurality of prongs statically coupled said base member and being seated adjacent to a rear edge of said base member, said prongs extending upwardly from a top surface of said base member and being registered orthogonal thereto;

a rectilinear guide rail statically mated to said prongs and spanning therebetween;

a plurality of stabilizing brackets statically affixed to said top surface of said base member, said stabilizing brackets being oppositely seated from said prongs and situated at a front edge of said base member;

a rectilinear shaft fixedly connected to said brackets and spanning therebetween;

a plurality of pulleys journaled about shaft and being rotatable about a fulcrum axis extending along said shaft, said pulleys being uniformly juxtaposed side-by-side such that said pulleys are freely reciprocated along said shaft while rotating about the fulcrum axis; and a plurality of anchor cables having respective first ends removably engaged with said prongs, said anchor cables further having respective second ends adapted to be anchored to an existing support surface at the elevated location for preventing said base member from undesirably moving away from the desired location;

wherein said pulleys are intercalated between said brackets and thereby provide a continuous and uniform surface for receiving and directing the cable to the elevated location.

10. The pulley suspension assembly of claim 9, wherein each of said prongs having respective longitudinal lengths registered orthogonal to said top surface of said base member, said guide rail being elevated above said top surface of said base member and maintaining a first vertical distance therefrom.

11. The pulley suspension assembly of claim 10, wherein each of said pulleys have coextensive diameters so that respective outer perimeters of said pulleys remain coplanar and uniformly span between said brackets.

12. The pulley suspension assembly of claim 11, wherein selected ones of said pulleys are independently rotatable about said shaft while remaining ones of said pulleys remain stationary.

13. The pulley suspension assembly of claim 11, wherein a top-most section of said outer perimeters of said pulleys maintain a fixed second vertical distance from said top surface of said base member, said second vertical distance being equal for each of said pulleys.

14. The pulley suspension assembly of claim 13, wherein said first vertical distance is less than said second vertical distance thereby defining a downwardly sloping travel path extending towards said rear edge of said base member.

15. The pulley suspension assembly of claim 9, further comprising: a plurality of disc-shaped washers intercalated between oppositely seated ones of said pulleys and corresponding ones of said brackets, said washers being configured in such a manner that said pulleys are prohibited from engaging said brackets during operating conditions.

16. The pulley suspension assembly of claim 9, wherein each of said pulleys comprises:

a primary bearing concentrically journaled about said shaft;

a rigid outer layer concentrically spaced about said primary bearing such that a cavity is defined between said rigid outer surface and said primary bearing, said outer layer being adapted to receive and guide the cable therealong;

a plurality of auxiliary ball bearings intercalated between said outer layer and said primary bearing respectively, said auxiliary bearings being arranged in such a manner that said auxiliary bearings are freely rotatable and displaced within said cavity; and a protective sheath conjoining an inner wall of said rigid outer layer, said protective sheath being contiguously abutted against an entire inner perimeter of said rigid outer layer for shielding said inner wall from said auxiliary bearings as said auxiliary bearing are displaced within said cavity during operating conditions.

17. A method for using pulley suspension assembly to vertically transport a cable to an elevated location, said method comprising the chronological steps of:

a. providing and positioning a base member at the elevated location;

b. providing and statically coupling a plurality of prongs to said base member such that said prongs are seated adjacent to a rear edge of said base member, said prongs extending upwardly from a top surface of said base member and being registered orthogonal thereto;

c. providing and statically mating a rectilinear guide rail to said prongs such that said guide rail spans therebetween;

d. providing and statically affixing a plurality of stabilizing brackets to said top surface of said base member by oppositely seating said stabilizing brackets from said prongs and thereby situating said stabilizing brackets at a front edge of said base member;

e. providing and fixedly connecting a rectilinear shaft to said brackets such that said shaft spans therebetween;

f. providing and journaling a plurality of pulleys about said shaft such that said pulleys are rotatable about a fulcrum axis extending along said shaft;

g. freely reciprocating said pulleys along said shaft while rotating said pulleys about the fulcrum axis;

h. providing and removably engaging respective first ends of a plurality of anchor cables with said prongs;

i. preventing said base member from undesirably moving away from the desired location by anchoring respective second ends of said anchor cables to an existing support surface at the elevated location; and j. providing a continuous and uniform surface for receiving and directing the cable to the elevated location by intercalating said pulleys between said brackets and uniformly juxtaposing said pulleys side-by-side respectively.

* * * * *